United States Patent [19]

Hausmann

[11] Patent Number: 5,041,198

[45] Date of Patent: Aug. 20, 1991

[54] METHOD AND AN APPARATUS FOR THE ELECTROCHEMICAL ROUGHENING OF A METALLIC SURFACE

[76] Inventor: Kurt Hausmann, Hans-Böckler-Str. 3-7, D-8903 Bobingen, Fed. Rep. of Germany

[21] Appl. No.: 592,829

[22] Filed: Oct. 4, 1990

[30] Foreign Application Priority Data

Oct. 18, 1989 [DE] Fed. Rep. of Germany ..... 3934683

[51] Int. Cl.[5] ..... C25F 3/04; C25F 7/00

[52] U.S. Cl. ..... 204/129.35; 204/129.4; 204/129.75; 204/206; 204/241; 204/269; 204/228; 204/225; 204/DIG. 9

[58] Field of Search ..... 204/129.35, 129.4, 129.75, 204/DIG. 9, 206, 269, 228, 225, 241

[56] References Cited

U.S. PATENT DOCUMENTS 3,926,767 12/1975 Brendlinger et al. ..... 204/206
4,214,961 7/1980 Anthony ..... 204/211
4,332,651 6/1982 Bemis et al. ..... 204/129.4 X
4,482,434 11/1984 Pliefke ..... 204/129.4 X
4,721,552 1/1988 Huang et al. ..... 204/129.4

*Primary Examiner*—Donald R. Valentine
*Attorney, Agent, or Firm*—Edwin D. Schindler

[57] ABSTRACT

In order to perform the electrochemical roughening of the surface of preferably strip-like metal substrate for the production of printing plates or the like so that the surface is free of smuts and stripes with an even distribution of the roughness, there is a roughening station with three zones and in each zone the current density, the frequency, the temperature of the electrolyte, the type of electrolyte and the residence time may be individually set. Accordingly in the first zone it is possible to use a higher frequency and a higher current density than in the second zone in order to produce a large number of points of attack. In the second zone a longer residence time serves to enlarge the points of attack which have already been formed. In the third zone a particularly high frequency may be used to remove smuts.

33 Claims, 1 Drawing Sheet

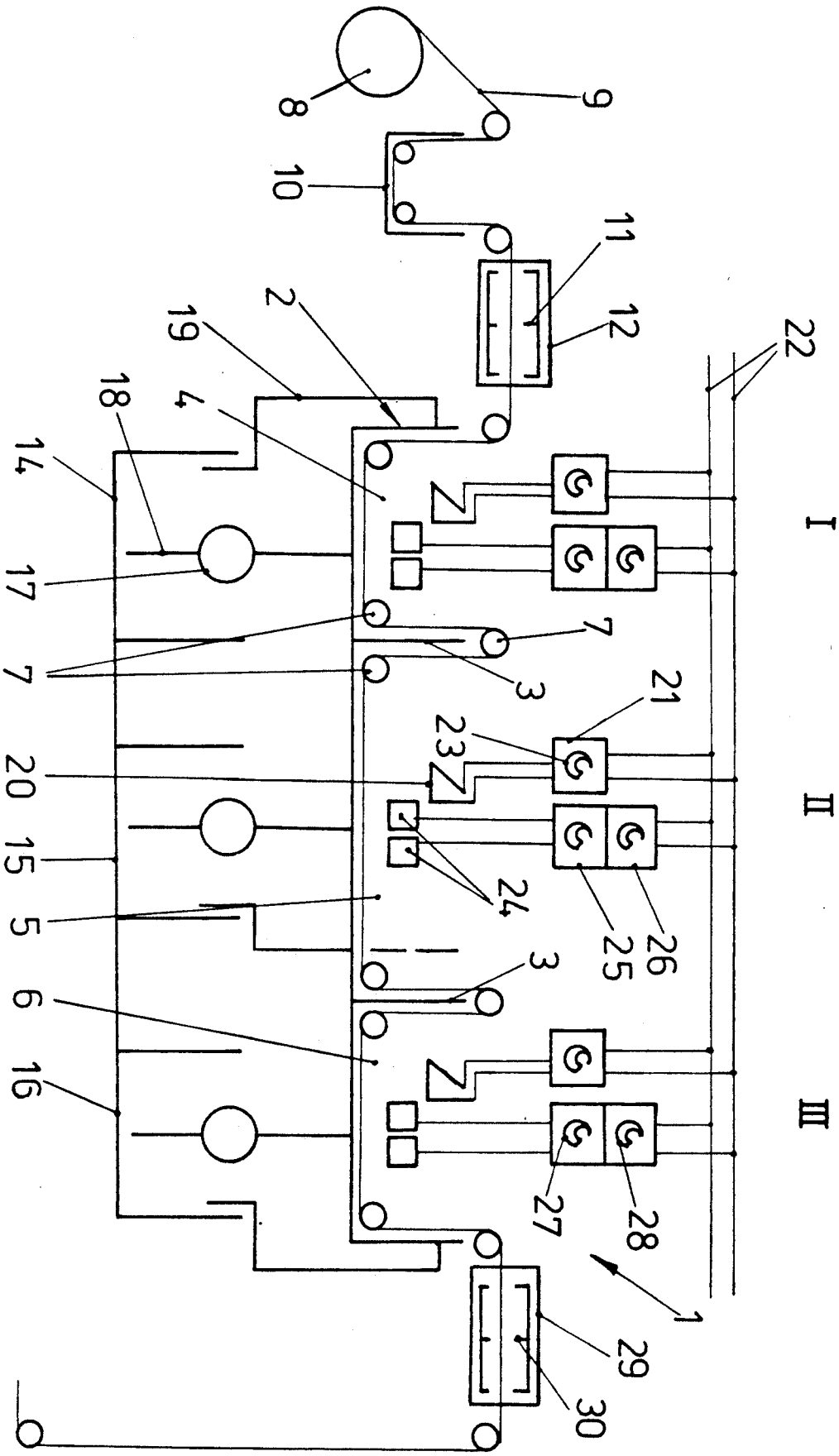
I
II
III
1
2
3
4
5
6
7
8
9
10
11
12
14
15
16
17
18
19
20
21
22
23
24
25
26
27
28
29
30

METHOD AND AN APPARATUS FOR THE ELECTROCHEMICAL ROUGHENING OF A METALLIC SURFACE

BADCKGROUND OF THE INVENTION

In accordance with a first aspect the present invention relates to a method for the electrochemical roughening of the surface of a more particularly strip-like metal substrate and in a more restricted sense of printing plates such as offset litho printing plate material, in which the metal substrate is preferably firstly degreased and is then introduced into an electrolyte bath having a plurality of zones and is exposed in each zone to the action of AC flowing in the bath and in accordance with a further aspect to a preferred apparatus for performing the method.

The U.S. Pat. No. 3,755,116 describes a method and an apparatus of the above-mentioned type, in which there are admittedly two zones with each of which there is a associated one chamber of a trough subdivided by a partition into two chambers. However, the partition is provided with a passage for the strip-like metal substrate so that the two chambers are in communication with each other and function as a single space. The selection of special roughening parameters, such as for instance the selection of a specific temperature for each of the zone and/or the selection of a specific electrolyte for each zone, is in this case not possible. Furthermore, the current density and current frequency are necessarily the same in the two zones. Although each chamber is provided with an electrode, the electrodes provided are connected with the same power supply so that the current density and frequency are the same throughout. If the case were different trouble conditions would be likely.

Experience has shown that in such an apparatus and with an acceptable degree of complexity of the plant it is only possible to achieve very irregular roughness with comparatively few deep depressions, which are irregularly distributed over the surface and are not smutfree. The result of the uneven roughness is visible stripes. In the case of the smuts deposited in the deep depressions it is a question of a sort of cluster of small particles detached from the surface. The result is thus black discoloration of the surface, this being undesired on printing plates, since it means that during printing there is no proper distinction between ink attracting and ink repelling areas. Therefore in the prior art a subsequent treatment in the form of subsequent etching and neutralization to remove smuts has been requred. Apart from this the production of a surface roughness suitable for the printing plates has only been possible if long residence or treatment times are employed. There is then the consequence of a higher energy requirement and the process is slower so that the method is less economic, even apart from the question of having to remove smuts.

SHORT SUMMARY OF THE PRESENT INVENTION

Accordingly one object of the present invention is to devise a method of the initially described type which is so improved by the use of simple and economic means that the product is not only evenly roughened but is not made essentially more expansive by the treatment.

A still further aim of the invention is to provide a product which is evenly roughened and has a surface free of stripes and smuts.

Yet another object of the present invention is to provide a suitable and particularly expedient apparatus for performing the method.

In order to achieve these or other objects appearing from the present specification, claims and drawings, in the present invention in the first zone the frequency of the current is larger and the current density is at least equal to the frequency and, respectively, the density in the second zone, the residence time in the second zone is longer than in the first zone, and in a third zone the current frequency is higher than in the first and second zones.

These features make it possible to achieve the object of the invention in a simple and economic manner. The relatively high frequency in the first stage leads to a relatively large number of points of attack over the extent of the surface to be roughened, that is to say it is at a comparatively large number of points on this surface that small depressions begin to form. Owing to the comparatively brief residence time in the first stage such depressions however remain comparatively small and it is only later in the period of the second stage that they grow extensively owing to the longer residence time therein. Owing to the lower frequency no essential change in the distribution takes place. The particularly high frequency then applied in the period of the third stage has the primary purpose of removal of smuts deposited in the meantime in the depressions. All in all the surface produced is free of stripes and smuts with a large number of evenly distributed and comparatively deep depressions with a depth of the surface roughness which is able to meet exacting requirements and has a regular distribution. Tests have shown that even in the case of application to awkward materials, as for instance Al 3003, which it has so far only been possible to roughen mechanically, it is possible to obtain a practically white, unstriped surface free of smuts and with a high quality roughness, this meaning not only an improvement on the quality of the prior art but also a reduction in the time and power required. A still further advantage of the features in accordance with the invention is to be seen in the fact that owing to the freedom from smuts there is not need for any type of subsequent treatment such as post-etching followed by neutralization and rinsing. the invention thus leads to excellent overall economics of the process.

It is an advantage if the current density in the extent of the first zone is also made greater than in the extent of the second zone. Owing to the comparatively heavy current used in the extent of the first zone the attack, taking place at a multiplicity of sites, on the surface to be roughened is particularly intensive.

In accordance with a further a further possible development of the invention the current density in the extent of the third zone has a value between the current density of the first and of the second zone. The result of this is to ensure that in the extent of the third zone there is essentially no further change in the roughness and it is primarily a question of removing smuts. Accordingly, a comparatively short residence time is sufficient in the extent of the third zone.

In keeping with yet another possible and convenient form of the invention in the extent of the third zone the residence time has a duration between that of the first and second zones. This is then fully sufficient for removal of smuts.

A further possible feature of the invention is such that at least in the extent of the first zone the electrolyte is at the maximum temperature. This is another feature for intensifying the attack, taking place at a multiplicity of sites, on the surface to be reoughened. Accordingly it is advantageous for the temperature of the electrolyte to be higher in the extent of the first zone than in the two other zones, the temperature of the electrolyte in the extent of the third zone preferably being between the electrolyte temperatures in the first and second zones.

As part of a further advantageous feature of the present invention it is possible to employ different electrolytes in the three zones. This makes possible an individual adaptation to the requirements of a particular application. Nevertheless it is possible for the electrolyte in the each stage to have at least one component in common, such component preferably being HCl with a preferred concentration of 5 g/l, in order to ensure economic plant operation.

Further features and advantages of the invention will be gathered from the claims relating the method of the invention.

Apparatus designed to attain the objects of the invention may be in the form of a roughening station defining a plurality of chambers which are able to be supplied with electrolyte able to be heated and have a submerged electrode, connected with a power supply, and with conveying means, preferably formed by conveying rollers for tranport of the substrate material, preferably in the form of a strip or band past the electrodes, with the feature in accordance with the invention that the chambers of a roughening station do not communicate with each other and each chamber has its own source of electrolyte and a preferably adjustable heating means and a power supply means allowing individually preselectable current density and frequency.

These measures make it possible to ensure that in the extent of each zone the current density, the frequency, the temperature of the electrolyte and the type of electrolyte which is employed, may be individually selected without mutual interference being likely.

In this respect in the case of a strip-like substrate material the path of this strip material through the chambers may be varied in length in order to correspond to the differences in the residence times aimed at. For this purpose the chambers may simply have a different working length. This makes it possible to achieve the desired different residence times in a simple manner despite the constant strip speed.

Further advantageous features and expendient forms of the invention will be seen from the apparatus claims.

Features and advantages of the invention will be gathered from the ensuing detailed description of one embodiment thereof referring to the single drawing, which is a diagrammatic showing of an apparatus for performing the roughening method in accordance with the invention.

DETAILED ACCOUNT OF EMBODIMENT OF THE INVENTION

For the production of offset litho plates or the like the starting stock is a strip of metal substrate, as for instance Al 1050 or Al 3003, whose surface is firstly to be roughened, then provided with an oxide coating and then treated with a so-called interlayer, before a photosensitive layer is applied to it. The apparatus shown in the drawing comprises a roughening station generally referenced 1. The station 1 has a trough-like container 2, which is subdivided by two partitions 3 into three chambers 4, 5 and 6. Inside and outside the chambers 4, 5 and 6 there are guide elements formed by bend rolls 7, over which the strip 9 runs from a coil 8 on which it is wound, such guide elements being placed so that the strip is passed through each of the chambers 4, 5 and 6 in the form of U-like loops. Some of the bend rolls 7 may be driven in order to convey the strip. However it is frequently sufficient in this respect merely to rely on the pulling force of a wind-up station which is not shown in detail.

Before the strip 9 runs into the roughening station 1, it is degreased and then rinsed. For this purpose the paying off station with the coil 8 therein is followed by a degreasing basin 10 filled with caustic soda or the like, through which the strip 9 is passed in the form of a U-like loop. Besides degreasing there is a simultaneous pre-etching effect. Then the strip 9 passes through a rinsing station 12 having spraying nozzles 11 discharging rinsing water thereon, in the plane of conveyance and arranged on both sides of the strip. After this pretreatment the strip enters the roughening station 1, in which electrochemical roughening is to take place thereon.

The roughening station 1 and accordingly the processing of the strip are divided up into three zones I, II and III corresponding to the number of chambers 4, 5 and 6 so that there is one chamber 4, 5 or 6 for each of the zones. The chambers 4, 5 and 6 respectively contain a charge of electrolytic liquid. This liquid consists substantially of water to which certain reactants have been added. The added reactants may consist of one or more components. In the present case HCl is to be present in all the three zones with a concentration of 5 g/l in all cases. In the zone I there is no further reactant other than the HCl. In the zone II there is $H_3BO_3$ with a concentration of 10 g/l in addition to the HCl. In the zone III $H_3BO_3$ is present in a concentration of 1 g/l in addition to the HCl. It would naturally be possible to have other reactants. Thus in lieu of hydrochloric acid it would be possible to use nitric acid or the like. The same applies for further electrolyte compositions in accordance with the prior art.

Since each of the chambers 4, 5 and 6 is to be able to be filled with an electrolyte with a customized composition, each chamber is provided with its own electrolyte storage container 14, 15 and, respectively, 16, whence there extends a supply pipe 18 provided with a pump 17 and leading to the associated chamber. In the illustrated working example of the invention the chambers 4, 5 and 6 are continuously supplied with their specific electrolyte so that there is a continuous flow therethrough. Accordingly there is a return duct 19, running from an overflow of each chamber 4, 5 and 6, to the associated storage container 14, 15 and 16.

In order to be able to keep each chamber 4, 5 and 6 at the desired temperature each one has its own heating means 20, which is able to be controlled by means of an associated controller 21. The heating means may be in the form of a continuous flow heater arranged in the supply line 18. In the illustrated working example of the invention the heating means 20 is designed in the form of a heating coil arranged in the respective chamber 4, 5 or 6. In the illustrated working example of the invention this heating coil is to be an electrical one and is accordingly connected with the electricity line 22. The regulator of the controller 21 is adjustable as is indicated by the scale 23.

The controllers 21 are to be so set in the present case that the temperature of the electrolyte is 36° C. in the chamber 4 of the zone I, is 28° C. in the chamber 5 of the zone II and is 31° C. in the chamber 6 of the zone III. The electrolyte temperature in the zone I may be between 30° C. and 40° C., that in the zone II may be between 20° C. and 40° C. and in the zone III between 25° C. and 35° C. Within these ranges the temperatures are so selected that in the zone I the electrolyte temperature is highest, in the zone II it is lowest and in the zone III it is at an intermediate value.

In order to apply the electric current each chamber 4, 5 and 6 contains a set of two electrodes 24 connected in the same circuit. The electrodes may be in the form of graphite blocks with a spacing between them and arranged so that the strip 9 is moved past under them. In such a case only the top side of the strip adjacent to the electrodes 24 is roughened, as is in fact the case with the production of printing plates. If both the sides of the strip are to be roughened, it is possible to provide oppositely placed electrodes, between which the strip is caused to move, or it is possible to have electrodes provided with suitable windows for the strip to run through. The electrodes 24 are supplied with AC from the distribution line 22. Each electrode set 24 is provided with its own frequency setting means 25 and a current and voltage setting means 26 designed in the form of a current or voltage amplifier and which are adjustable, as is indicated by the scale 27 and, respectively, 28.

In the present case the frequency setting means 25 are to be so adjusted that in the zone I there is a current frequency of 210 Hz, in the zone II one of 45 Hz and in the zone III one of 315 Hz. The frequency in the zone I may be between 120 Hz and 240 Hz, in the zone II between 20 Hz and 80 Hz and in the zone III between 250 Hz and 360 Hz. Within these ranges the frequency is always so selected that in the zone I it is much higher than in the zone II but is less than in the zone III, in which it has its highest value. The current and voltage setting means 26 are in the present case so set that in the extent of the zone I there is a current density of 50 $A/dm^2$, in the zone II one of 20 $A/dm^2$ and in the zone III one of 30 $A/dm^2$. The current density in the extent of the zone I may be between 40 $A/dm^2$ and 80 $A/dm^2$, in the extent of the zone II between 10 $A/dm^2$ and 30 $A/dm^2$ and in the zone III between 15 $A/dm^2$ and 50 $A/dm^2$. Within these ranges the value of the current density is always so set that in the extent of the first zone I the current density is highest and in the extent of the second zone II it is lowest while in the extent of the third zone III it has an intermediate value.

The strip is to be moved at a constant speed. The paths of the strip 9 through the zones I, II and II are accordingly to be so selected that there are the desired residence times therein. In the present case different residence times are desired. The chambers 4, 5 and 6 of the three zones I, II and III accordingly have a different clearance or working width dependent on the desired residence time. In the extent of the zone II the longest residence time is desired. Accordingly the chamber 5 of this zone II has the greatest length. In the zone I the shortest residence time is desired. Accordingly the chamber 4 in the zone I is the shortest chamber. The length of the chamber 6 is between the lengths of the chambers 4 and 5. The lengths of the chambers are in this case such that in the chamber 4 in the zone I there is a residence time of 3 seconds, in the chamber 5 belonging to the zone II there is one of 10 seconds and in the chamber 6 of the zone III there is a residence time of 4 seconds. In the case of permanently set chamber lengths, as here, the residence time may be varied by changing the strip velocity. The effective range in the case of the chamber 4 of the zone I is 2 to 5 seconds, while for the chamber 5 belonging to the zone II it is 6 to 15 seconds and for the chamber 6 belonging to the zone III it is 2 to 6 seconds.

When the electrodes 24 are supplied with current an electrochemical process is started, by which the surface of the stirp 9 adjacent to the electrodes 24 is roughened. The high frequency and current density and the short residence time in the extent of the zone I accordingly lead to the formation of a large number of depressions with are accordingly regularly distributed over the surface to be roughened. However they remain small in size. In the extent of the zone II, in which there is a long residence time but a comparatively low current density and a low frequency, these depressions are considerably enlarged. Owing to the lower current density and the low frequency of the current hardly any new depressions are created and instead it is only a question of the points of attack which resulted in the zone I being enlarged. A large amount of the material dissolved out of the strip 9 deposits in the form of smuts in the depressions which have been produced. In order to dislodge these smuts and swill them away the strip is subjected in the zone III to a very high frequency and to a medium current density.

In tests performed on a strip of Al 1050 in the zone I the current density amounted to 50 $A/dm^2$, the current frequency 210 Hz, the residence time 3 seconds and the temperature 36° C. The treatment solution was made up of water and 5 g/l HCl. In the zone II the current density also amounted to 50 $Al/dm^2$, the frequency amounted to 45 Hz, the residence time 10 seconds and the electrolyte temperature 28° C. The solution was made up of water and 5 g/l HCl and also $H_3BO_3$ with a concentration of 10 g/l. In the zone III the current density again amounted to 50 $Al/dm^2$, the current frequency 315 Hz, the residence time 4 seconds and the temperature of the electrolyte 31° C. The solution was made up of water with 5 g/l of HCl and 1 g/l $H_3BO_3$. The finished strip had a very regular, practically white surface free of stripes and smuts.

In the case of a further test with a strip consisting of Al 3003 the current density in the zone I was 50 $Al/dm^2$, in the zone II 20 $A/dm^2$ and in the zone III 50 $A/dm^2$. In other respects the parameters were the same as in the first test. The roughened surface of the strip processed in this manner was practically the same as in the first test despite the well known difficulty in roughening Al 3003, but the optical density was somewhat higher.

After the strip 9 leaves the roughening station 1 it passes to a rinsing or swilling station 29 following the roughening station 1, in which water is sprayed from nozzles 30 arranged on both sides of the plane of conveyance. The strip 9 may then be passed on to an anodizing unit which is not shown in which the roughened surface is given an oxide layer. Then the strip may pass to a station for the provision of a so-called interlayer. The strip which has been roughened and provided with an interlayer forms the basic material for the production of printing plates. For this purpose the strip is cut up and previously or thereafter provided with a photosensitive layer.

I claim:

1. A method for the electrochemical roughening of the surface of metal substrate material, in which the metal substrate is introduced into an electrolyte bath having three zones and is exposed in each zone to the action of AC flowing in the bath, the current frequency in the first zone is higher than in the second zone, the current density in the first zone is at least equal to the current density in the second zone, the residence time in the second zone is longer than in the first zone and in the third zone the frequency of the current is higher than in the first and in the second zones.

2. The method as claimed in claim 1, wherein the current density in the first zone is also higher than in the second zone.

3. The method as claimed in claim 2, wherein the current density in the third zone is between the current density in the first zone and the current density in the second zone.

4. The method as claimed in claim 1, wherein the residence time in the third zone is at least equal to the residence time in the first zone and at the most equal the residence time in the second zone.

5. The method as claimed in claim 4, wherein the residence time in the third zone is between the residence times in the first and in the second zone.

6. The method as claimed in claim 1, wherein the electrolyte is at a maximum temperature at least in the first zone.

7. The method as claimed in claim 6, wherein in the first zone the temperature of the electrolyte is higher than in the second and thrid zones and in the third zone the electrolyte temperature is between the electrolyte temperature in the first zone and the electrolyte temperature in the second zone.

8. The method as claimed in claim 1, wherein different electrolytes are used in the three said zones.

9. The method as claimed in claim 1, wherein in each zone the electrolyte has at least one common added component, preferably in the form of HCl with a concentration of 5 g/l.

10. The method as claimed in claim 9, wherein the electrolyte in the first zone contains exclusively the said common added component preferably in the form of HCl.

11. The method as claimed in claim 9 wherein the electrolyte in the second zone part from the said added component common to all three zones contains a further added component, preferably in the form of $H_3BO_3$ with a concentration of 10 g/l.

12. The method as claimed in claim 9 wherein the electrolyte in the third zone apart from the said added component common to all the three zones contains a further added component, preferably in the form of $H_3BO_3$ with a concentration preferably lower than in the second zone, preferably 1 g/l.

13. The method as claimed in claim 1, wherein the current frequency in the first zone is in a range of between 120 Hz and 240 Hz and preferably has a value of 210 Hz.

14. The method as claimed in claim 1, wherein the current frequency in the second zone is in a range between 20 Hz and 80 Hz and preferably has a value of 45 Hz.

15. The method as claimed in claim 1, wherein the current frequency in the third zone is in a range of between 250 Hz and 350 Hz and preferably has a value of 315 Hz.

16. The method as claimed in claim 1, wherein the current density in the first zone is in a range of between 40 A/dm$^2$ and 80 A/dm$^2$ and preferably has a value of 50 A/dm$^2$.

17. The method as claimed in claim 1, wherein the current density in the second zone has a value in a range of between 10 A/dm$^2$ and 30 A/dm$^2$, and preferably has a value of 20 A/dm$^2$.

18. The method as claimed in claim 1, wherein the current density in the third zone is in a range between 15 A/dm$^2$ and 50 A/dm$^2$ and preferably has a value of 30 A/dm$^2$.

19. The method as claimed in claim 1, wherein the temperature of the electrolyte in the first zone is in a range between 30° C. and 40° C. and preferably has a value of 36° C.

20. The method as claimed in claim 1, wherein the temperature of the electrolyte in the second zone is in a range between 20° C. and 40° C., and preferably has a value of 28° C.

21. The method as claimed in claim 1, wherein the temperature of the elelctrolyte in the third zone is in a range between 20° C. and 35° C. and preferably has a value of 31° C.

22. The method of claimed in claim 1, wherein the residence time of the metal substrate in the first zone is in a range between 2 seconds and 5 seconds and preferably has a value of 3 seconds.

23. The method as claimed in claim 1, wherein the residence time in the second zone is in a range between 6 seconds and 15 seconds and preferably has a value of 10 seconds.

24. The method as claimed in claim 1, wherein the residence time in the third id zone is between 2 seconds and 6 seconds and preferably has a value of 4 seconds.

25. The method as claimed in claim 1, wherein in the case of the use of Al 1050 as the substrate material the current density has a value of 50 A/dm$^2$ in all three zones and in that the preferred values for frequency, residence time, temperature of the electrolyte are adhered to and the preferred type of electrolyte is used.

26. The method as claimed in claim 1, wherein the substrate material is Al 3003, the current density in the first and third zones is 50 A/dm$^2$ and in the second zone is 20 A/dm$^2$ and the preferred values are adhered to for the frequency, the residence time, the temperature of the electrolyte and the type of electrolyte.

27. The method as claimed in claim 1, wherein said metal substrate is strip sheet metal and is degreased prior to entering the first zone.

28. An apparatus for roughening a metal substrate with a roughening station comprising three chambers each having means for the supply thereto of heatable electrolytic liquid and each having at least one submerged electrode therein which may be connected with a power supply, and with conveying means, preferably formed by conveying rolls for conveying the metal substrate, which is preferably in the form of strip, past the electrodes, said chambers of a roughening chambers are not in communication with each other and each chamber has its own electrolyte supply and its own preferably adjustable heating means, and a power supply for supply with a separately set current density and current frequency.

29. The apparatus as claimed in claim 28, wherein the strip-like metal substrate has different lengths in the different chambers through which it passes in accordance with the desired residence times in the said chambers.

30. The apparatus a claimed in claim 29 wherein the chamber associated with the second zone is longer than the first chamber associated with the first zone.

31. The apparatus as claimed in claim 30, wherein the length of the third chamber in zone is at the most as long as the first chamber and at the most is as long as the second chamber and preferably its length has a value between the lengths of the first and second chambers.

32. The apparatus as claimed in claim 28 wherein each chamber is provided with a preferably adjustable frequency amplifier and current or voltage amplifier.

33. The apparatus as claimed in claim 28, wherein each chamber is provided with a set of two electrodes.

* * * * *